US006419588B1

(12) United States Patent
Watlack et al.

(10) Patent No.: US 6,419,588 B1
(45) Date of Patent: Jul. 16, 2002

(54) ASSISTIVE BILLIARD CUE DEVICE

(75) Inventors: Hubert T. Watlack, 69 Kirklees Rd., Pittsford, NY (US) 14534; Edward J. Watlack, Pittsford, NY (US)

(73) Assignee: Hubert T. Watlack, Pittsford, NY (US)

( * ) Notice: Subject to any disclaimer, the term of this patent is extended or adjusted under 35 U.S.C. 154(b) by 32 days.

(21) Appl. No.: 09/585,956

(22) Filed: Jun. 2, 2000

(51) Int. Cl.[7] ..... A63D 15/10
(52) U.S. Cl. ..... 473/42; 473/1
(58) Field of Search ..... 473/1, 2, 36, 38, 473/41, 42, 43, FOR 1; D21/726; D7/637

(56) References Cited

U.S. PATENT DOCUMENTS

| | | | | |
|---|---|---|---|---|
| 196,568 | A | * 10/1877 | Doughty | 473/42 |
| 199,105 | A | * 1/1878 | Prentice | 473/42 |
| 211,416 | A | * 1/1879 | McIntire | 473/42 |
| 3,416,797 | A | 12/1968 | Ciano | |
| 3,836,145 | A | 9/1974 | Frejd | |
| 4,053,153 | A | 10/1977 | Josenhans | |
| D251,308 | S | 3/1979 | Drake | |
| 4,629,187 | A | 12/1986 | Mirowski | |
| D291,466 | S | 8/1987 | Traube | |
| D293,700 | S | 1/1988 | Rosewarne | |
| D294,851 | S | 3/1988 | Nicotra | |
| D300,235 | S | 3/1989 | Nicotra | |
| 4,907,799 | A | 3/1990 | Danner et al. | |
| D312,290 | S | 11/1990 | Rodriguez | |
| D317,808 | S | 6/1991 | Reyes | |
| 5,165,681 | A | 11/1992 | Enger et al. | |
| 5,295,682 | A | 3/1994 | Leonard | |
| 5,332,185 | A | 7/1994 | Walker, III | |
| D354,106 | S | 1/1995 | Thompson | |
| D387,114 | S | 12/1997 | Bliss | |
| D391,614 | S | 3/1998 | Meredith | |
| 5,846,137 | A | 12/1998 | Tremblay | |
| 5,853,333 | A | 12/1998 | Patterson | |

FOREIGN PATENT DOCUMENTS

| | | | | |
|---|---|---|---|---|
| FR | 2680978 | * 3/1993 | | 473/42 |

* cited by examiner

*Primary Examiner*—Paul T. Sewell
*Assistant Examiner*—Mitra Aryanpour
(74) *Attorney, Agent, or Firm*—Eugene Stephens & Associates

(57) ABSTRACT

An assistive cue device securely holds a cue and allows one-handed billiards play. In the preferred embodiment, a control guide slidingly mounted on the shaft grips the cue while a head of the device retains the tip of the cue in a cue hole. The head and a slide retainer ring are connected by a shaft, along which the control guide slides with the cue when the player moves the cue. The head has a plurality of supports, preferably in the form of sides of a polygonal cross-section, upon which the head can rest, each of which provides an elevation for the cue above the surface of the table. The player can change the elevation of the cue simply be rotating the whole assembly so that a different support of the head rests on the table.

25 Claims, 4 Drawing Sheets

ASSISTIVE BILLIARD CUE DEVICE

TECHNICAL FIELD

The invention relates to the game of billiards and hardware used to play billiards.

BACKGROUND OF THE INVENTION

Various forms of the game of billiards are enjoyed around the world. Every year, many billiards enthusiasts are injured in such a way that they can no longer use a billiard cue and thus must abandon their enjoyment of the game. In addition, many non-enthusiasts who have suffered injuries incapacitating one or both arms can not take up billiards since they can not use a billiard cue.

U.S. Pat. No. 3,846,145 to Frejd discloses an assistive cue holder that aims to overcome the disabilities that prevent enthusiasts and enthusiasts-to-be from playing billiards. The Frejd device includes a triangular head that is weighted along one edge to keep the edge always oriented toward and resting on the table. Several holes in the head allow for different positioning of the cue. A rod extends from the head toward the user and supports a guide member in which a felt ring slidingly supports the cue, The cue just slides through the guide and nothing holds the cue and the holder together. Thus, the Frejd device suffers from several disadvantages. The cue must be inserted into a hole in the head and in the guide member with nothing to retain the cue in the holder, presenting an opportunity for the cue to fall out of the holder. To change the aim or elevation of the cue above the table with the Frejd device, the user must withdraw the cue from the head and insert it into another hole, presenting another opportunity for the cue to fall away from the holder. Finally, during use, nothing prevents the cue from being drawn too far back, resulting in a miscue should the tip be drawn out of the head or out of the guide member. To provide disabled billiards enthusiasts with a truly assistive device, enabling the player to play the game worry-free, the market must offer something better.

SUMMARY OF THE INVENTION

Our invention overcomes all of the disadvantages of the prior art, particularly those of Frejd. Our control guide holds the cue firmly to maintain the angular relationship between the cue, the control guide, and the head at all times. The control guide slides along the shaft as the player moves the cue, but will not move beyond the end of the shaft, ensuring that the tip of the cue can not leave our special head. Our unique head allows the player to change the aim of the cue simply by rotating the assistive device and cue so that the cue never leaves the head, and when made or used with only a shaft, the head can be implemented as a bridge for use by any player. Our assistive device provides disabled players with the means to better enjoy the game of billiards.

DESCRIPTION OF THE INVENTION

Figure 1:
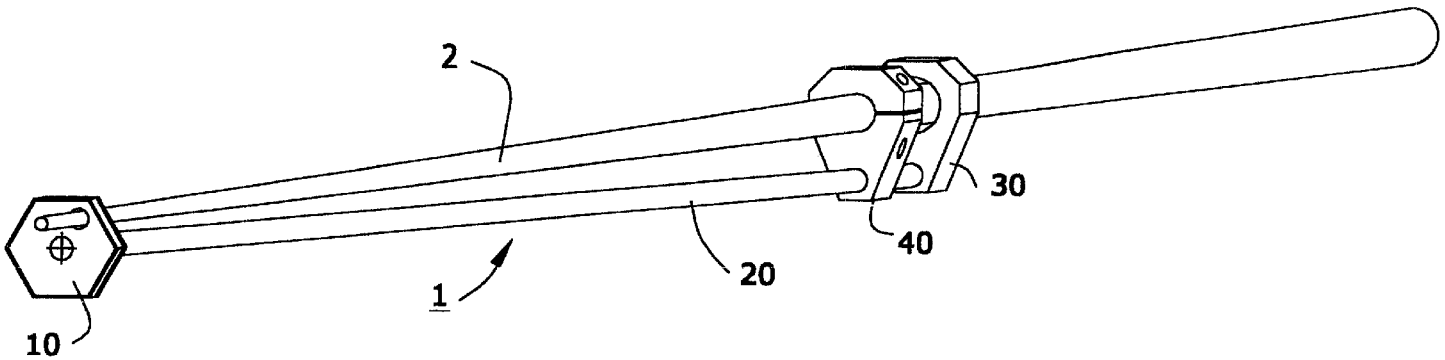
FIG. 1 is a schematic elevational view of a preferred embodiment of the invention.
Figure 2:
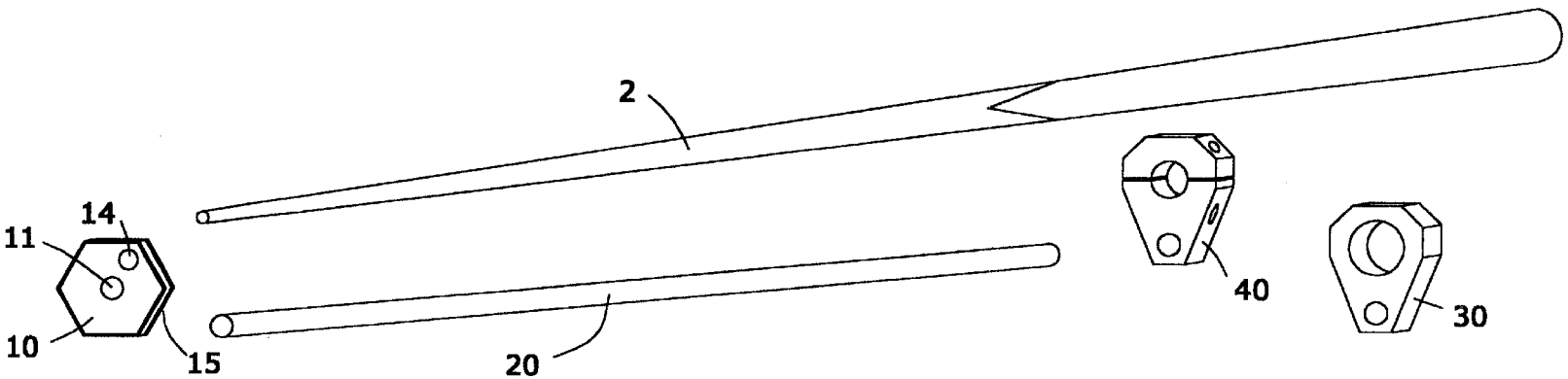
FIG. 2 is a schematic exploded view of the embodiment of the invention shown in FIG. 1.
Figure 3:
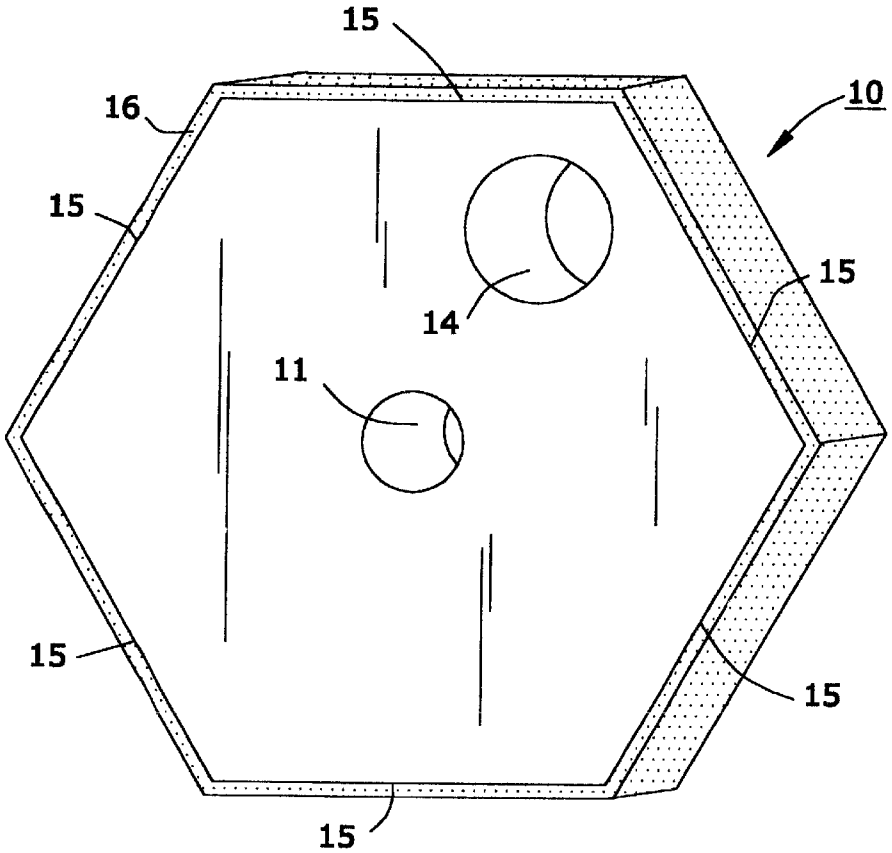
FIG. 3 is an enlarged schematic elevational view of the preferred head of the invention.
Figure 6:
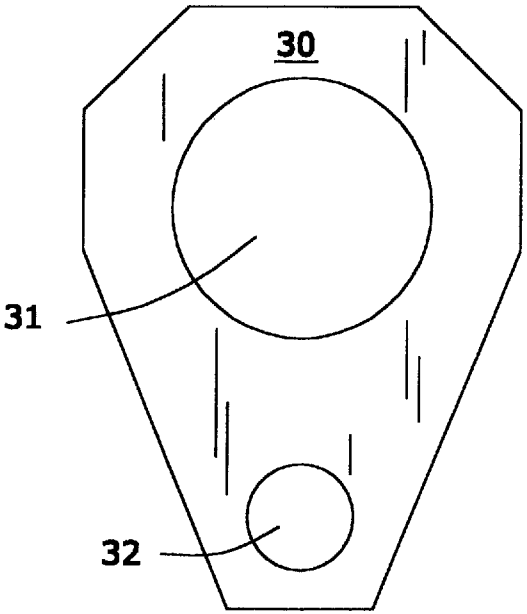
FIG. 6 is an enlarged schematic view of the preferred control guide of the preferred embodiment of the invention shown in FIGS. 1 and 2.
Figure 8:
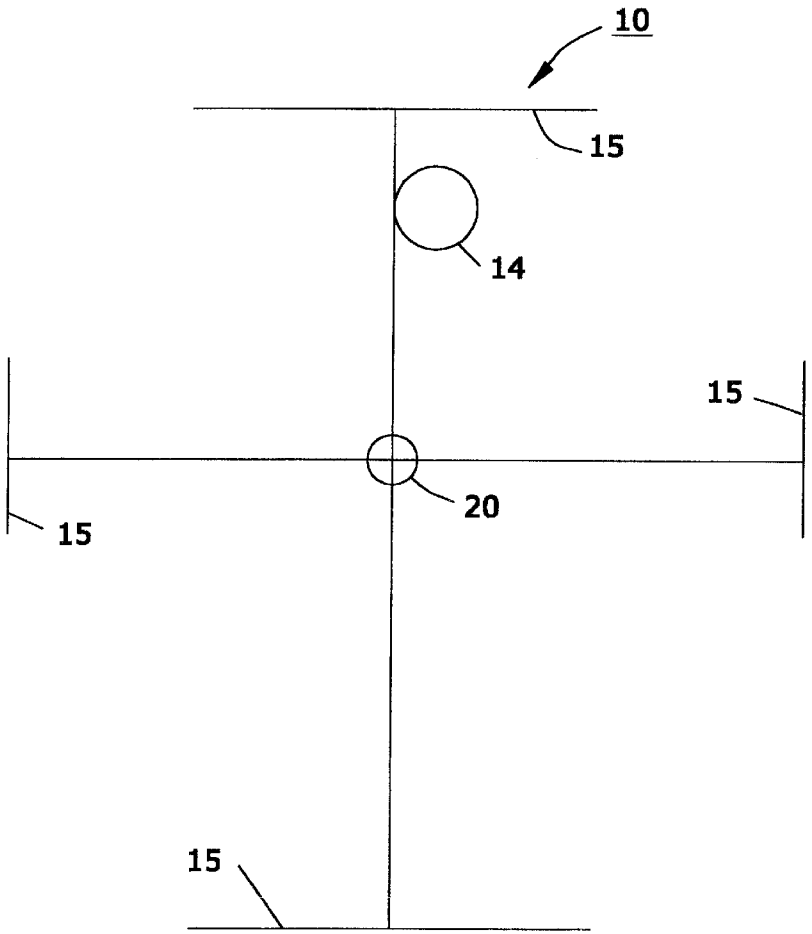
FIGS. 7 and 8 are schematic representations of some alternate arrangements of the supports of the head of the invention.
Figure 7:
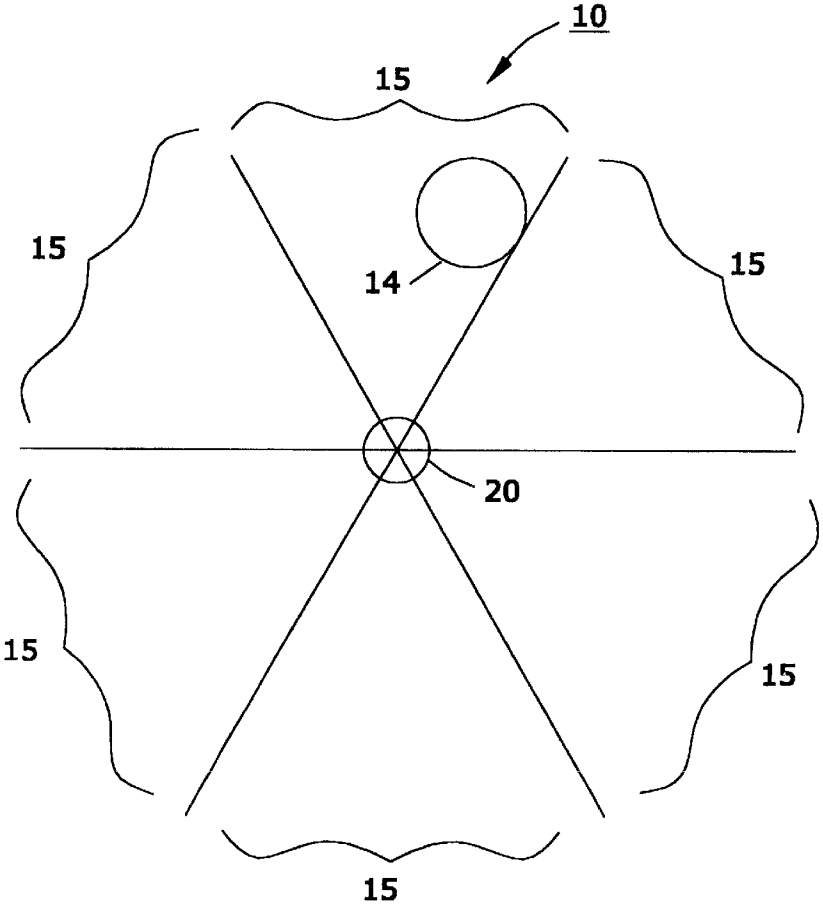

As seen in FIG. 1, our assistive cue device 1 supports and guides the tip end of a cue 2 with a head 10. The head 10 is mounted on a shaft 20 that also supports a control guide 40, which receives and supports a rear end of the cue 2. In our preferred embodiment, we affix the head 10 to the front end of the shaft 20. We prefer to affix the head 10 onto the shaft 20 with corresponding threads on both members. A slide retainer ring 30 on the other end of the shaft 20 receives the butt end of the cue 2 in cue retainer cue hole 31 and is preferably held on the shaft 20 with threads in retainer shaft hole 32, in much the same way that the head 10 is held on the shaft 20. The head 10 and slide retainer ring 30 could be attached to the shaft 20 by other methods or even formed as one piece with the shaft 20. The control guide 40, in the preferred embodiment, preferably clamps onto the cue 2 and slides with the cue 2 along the shaft 20 as the player moves the cue 2. Our device 1 thus allows the player to play billiards with one hand, altering the elevation of the cue 2 by rotating the cue 2 and device 1 as a unit, The head 10, as best seen in FIG. 3, preferably includes a central hole 11 into which the shaft 20 extends, an eccentric head cue hole 14 through which the tip of the cue 2 extends, and a plurality of sides 15 on which the head 10 rest when in use. The head 10 includes a plurality of supports 15 that elevate the eccentric head cue hole 14 to different levels. The supports 15 could be radially arranged legs, pairs of which would act as supports 15, radially arranged legs with feet that would act as supports 15, or sides of a polygonal head 10. Some schematic representations of such alternate supports 15 of the head 10 appear in FIGS. 7 and 8. We prefer to form the head 10 with a polygonal cross section using its sides as its supports 15, each of which provide a unique elevation of the head cue hole 14 from the surface of the table, thus enabling a wide variety of shots with the device 1. Though a wide variety of head 10 arrangements can be used, we prefer to use a hexagonal head 10 with top, bottom, and upper sides of about 2.375 inches and lower sides of about 3 inches. In this preferred arrangement we place the center of the head cue hole 14 about 1.62 inches away from the center of the shaft hole 11 and about 0.625 inches away from the top side so that the sides can elevate the center of the head cue hole 14 to about 4 inches, 0.625 inches, 1.59 inches, 1.72 inches, and 3.44 inches when resting on various sides 15 of the head 10. We have found that our preferred arrangement of the head 10 allows the most flexibility for the player.

Figure 4:
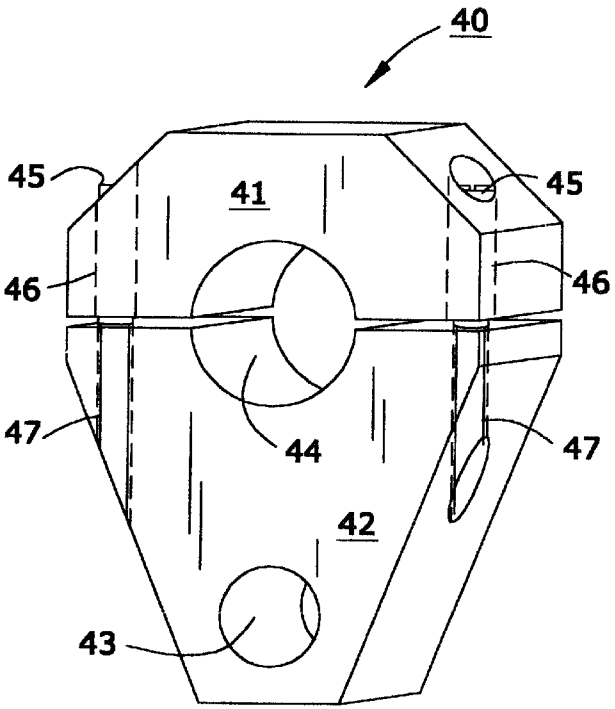
FIG. 4 is an enlarged schematic elevational view of the preferred control guide of the embodiment of the invention shown in FIGS. 1 and 2.
Figure 5:
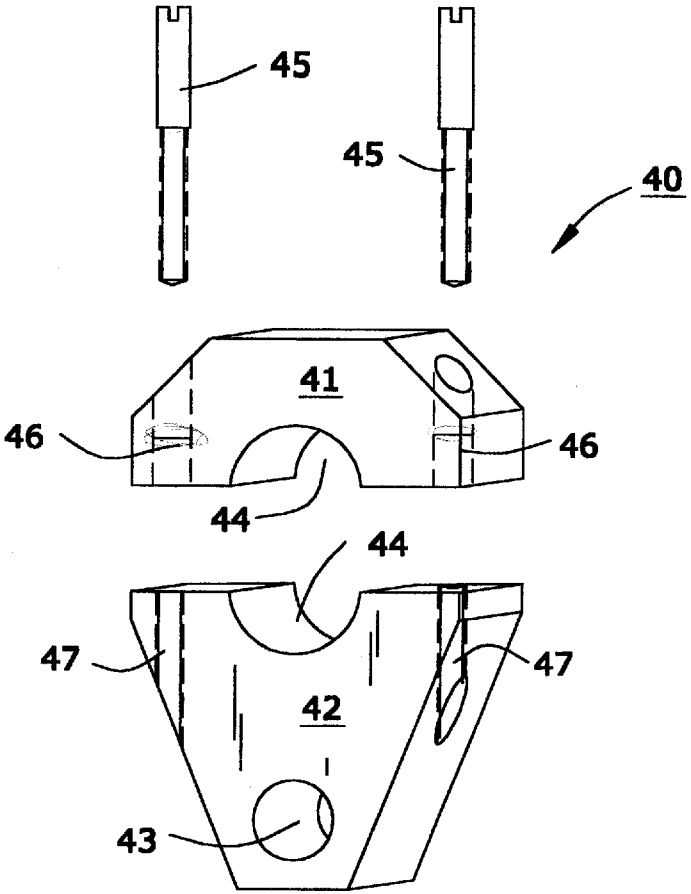
FIG. 5 is a schematic exploded view of the control guide shown in FIG. 4.

Our preferred control guide 40, seen best in FIGS. 4 and 5, includes a top portion 41 and bottom portion 42 mounted on opposite sides of a player's cue 2 when in use. The bottom portion 42 of the control guide 40 slides along the shaft 20 via guide shaft hole 43. The top and bottom portions 41, 42 of the control guide 40 form a guide cue hole 44 and securely grip the cue 2 as a result of pressure applied by a clamping mechanism, preferably including tightening screws 45 extending through bores 46, 47 in the top and bottom portions, respectively. For easy adjustability, assembly, and disassembly, the screws 45 can be a type the user can adjust without tools; we contemplate very few instances of assembly and disassembly since most players will probably use a custom cue and case to carry the entire device 1 complete with cue 2 already mounted therein and therefore prefer to use screws 45 adjustable with a screwdriver or the like. Other types of tighteners besides screws 45 could also be used within the spirit of the invention so long as the top and bottom portions 41, 42 of the control guide 40 are drawn toward each other to secure the control guide 40 to the cue 2.

To mount a cue 2 in our assistive device, the player inserts the tip of the cue 2 through the head cue hole 14 of the head 10, inserts the butt of the cue 2 through the retainer cue hole 31, and clamps the slide retainer ring 40 on the butt end of the cue 2. Once the cue 2 is mounted in the device 1, the player grips the cue 2 and rotates the assembly so that it rests on a desired side 15 of the head 10, then shoots. Thus, our device provides true one-handed billiards playing ability. With proper sizing of the control guide 40, the player need not support the weight of the assembly while taking a shot. We also prefer to place an anti-skid material 16 on the periphery of the head 10 to hold the head 10 in position on the table as the player takes a shot and to protect the table from damage from the head 10. The slide retainer ring 30 and the control guide 40 can also be fitted with such anti-skid material. Preferably, the anti-skid material 16 is somewhat resilient, and we prefer to use rubber or similar material.

Our device can also be used as a new type of bridge for use by any player if only the head 10 and shaft 20 are assembled. In such a case, the head 10 would be mounted on the shaft 20 substantially as described, but the player would hold the shaft 20 with one hand while inserting the cue 2 through the cue hole 14 and shooting with the other hand. While this does not provide one-handed billiards play. it does provide a superior bridge that allows for more secure bridge-assisted shooting.

For optimal strength-to-weight and cost, we prefer to form as much of the assistive device from plastics as possible, though any other suitable materials could be used. In addition, other sizes of the head, shaft, control guide, and/or sliding retainer ring can be used without departing from the spirit of the invention. Similarly, other cue tip elevations can be provided by the device without departing from the spirit of our invention.

PARTS LIST

1 Assistive cue device
2 Exemplary cue
10 Head
11 Central hole of head
14 Cue hole of head
15 Support/side of head
16 Anti-skid material
20 Shaft
30 Slide retainer ring
31 Retainer cue hole
32 Retainer shaft hole
40 Control guide
41 Top portion of control guide
42 Bottom portion of control guide
43 Shaft hole of control guide
44 Cue hole of control guide
45 Clamping screw
46 Bore in top portion of control guide for clamping screw
47 Bore in bottom portion of control guide for clamping screw

We claim:

1. An assistive cue device including a head mounted on a tip end of a shaft, the head having an eccentric hole therethrough and a plurality of supports for -selectively supporting the head on a billiards table and elevating said eccentric hole to a respective height above a playing surface of the billiards table, a slide retainer ring on an end of the shaft opposite the head, the slide retainer ring including a retainer cue hole through which a butt end of a cue extends when its tip end extends through the eccentric hole, and a control guide slidingly supported on the shaft, which control guide selectively clamps onto a cue to maintain an angular position of the cue relative to the shaft and head, the assistive cue device thereby allowing a user to hold a butt end of a cue in one hand, with the tip end of the cue through the eccentric hole of the head and the butt end of the cue through the retainer cue hole in the slide retainer ring, and rotate the head so that it rests on a support corresponding to a height from which the user prefers to take a shot.

2. The assistive cue device of claim 1 wherein the supports are substantially planar sides arranged to give the head a substantially polygonal cross section when viewed from a point along a longitudinal axis of the head, each side of the head being a respective support.

3. The assistive cue device of claim 2 wherein the head has six sides so that the head cross-section is a hexagon.

4. The assistive cue device of claim 3 wherein a first side that is closest to the eccentric hole and a second side that is opposite the first side are substantially equal in length.

5. The assistive cue device of claim 3 wherein sides immediately adjacent a first side that is closest to the eccentric hole are substantially equal in length to each other.

6. The assistive cue device of claim 3 wherein sides immediately adjacent a second side opposite a first side that is closest to the eccentric hole are substantially equal in length to each other.

7. The assistive cue device of claim 3 wherein a center of the eccentric hole is approximately 1.62 inches away from a center of the head and 0.625 inch away from a first side that is closest to the eccentric hole.

8. The assistive cue device of claim 7 wherein a distance between the first side and a second side opposite the first side is approximately 5 inches.

9. The assistive cue device of claim 1 wherein the center of the eccentric hole is approximately 4 inches above the surface of the table when the head rests on one of its sides.

10. The assistive cue device of claim 1 wherein the center of the eccentric hole is approximately 0.625 inches above the surface of the table when the head rests on one of its sides.

11. The assistive cue device of claim 1 wherein the center of the eccentric hole is approximately 1.59 inches above the surface of the table when the head rests on one of its sides.

12. The assistive cue device of claim 1 wherein the center of the eccentric hole is approximately 1.72 inches above the surface of the table when the head rests on one of its sides.

13. The assistive cue device of claim 1 wherein the center of the eccentric hole is approximately 3.44 inches above the surface of the table when the head rests on one of its sides.

14. The assistive cue device of claim 1 wherein the sides of the head are sized and the eccentric position is arranged so that the eccentric hole can occupy a different elevation above the surface of the table for each side on which the head can rest.

15. An assistive cue device, including a head mounted on a tip end of a shaft, the head having an eccentric hole therethrough and a plurality of supports for selectively supporting the head on a billiards table and elevating said eccentric hole to a respective height above a playing surface of the billiards table, wherein the shaft slidingly supports a control guide that selectively clamps onto a cue to maintain an angular position of the cue relative to the shaft and head when a tip of the cue extends through the eccentric hole, thereby allowing single hand operation of the cue and assistive cue device.

16. The assistive cue device of claim 15 further including a slide retainer ring on an end of the shaft opposite the head, the slide retainer ring including a retainer cue hole through which a butt end of a cue extends when its tip end extends through the eccentric hole and the control guide is clamped thereon.

17. The assistive cue device of claim 1 wherein the head further includes an anti-skid material on its periphery.

18. An assistive cue device including a control guide selectively clampable onto a cue and slidingly mounted on a shaft of the device so that the control guide maintains an angular relationship of the cue relative to the shaft, a head of the device affixed to a tip end of the shaft and through which a tip end of the cue slidingly extends, and a slide retainer ring of the device affixed to a butt end of the shaft and through which a butt end of the cue extends.

19. The assistive cue device of claim 18 wherein the control guide prevents withdrawal of the cue from the head.

20. The assistive cue device of claim 18 wherein the control guide prevents withdrawal of the cue from the slide retainer ring.

21. The assistive cue device of claim 18 wherein the control guide includes a clamp with which it clamps onto the cue and a slider with which the control guide slides along the shaft, the clamp including first and second opposed members and a tightening mechanism, the cue extending between the first and second members, and the tightening mechanism drawing the first and second members together to clamp them upon the cue.

22. The assistive cue device of claim 21 wherein the tightening mechanism includes threads.

23. The assistive cue device of claim 18 wherein the head has a plurality of supports, can rest upon any of the supports, and elevates the tip end of the cue to a respective elevation above a playing surface of a billiards table for each support upon which it rests.

24. The assistive cue device of claim 23 wherein each respective elevation is unique as compared to the other respective elevations.

25. An assistive cue device including:

a shaft fixedly supporting a head and a slide retainer ring at opposite ends of the shaft;

a control guide mounted on the shaft and including a clamp selectively fixedly retaining a billiard cue;

a head cue hole in the head through which a tip end of the billiard cue extends when the clamp retains the cue; and a retainer cue hole in the slide retainer ring through which a butt end of the cue extends when the clamp retains the cue, the retainer cue hole acting with the head cue hole and the control guide to keep the cue substantially parallel with the shaft, yet allow a user to slide the cue back and forth relative to the head, shaft, and slide retainer ring so that a user can aim and shoot a billiards ball using only one appendage, the slide retainer ring and control guide preventing withdrawal of the tip end of the cue from the head, the control guide further maintaining an angular position of the cue relative to the head, shaft, and slide retainer ring.

* * * * *